US010040655B2

(12) United States Patent
Dax

(10) Patent No.: US 10,040,655 B2
(45) Date of Patent: Aug. 7, 2018

(54) DEVICE AND METHOD FOR CONVEYING FLAT OBJECTS

(71) Applicant: Ferag AG, Hinwil (CH)

(72) Inventor: Roman Dax, Bäretswil (CH)

(73) Assignee: FERAG AG, Hinwil (CH)

( * ) Notice: Subject to any disclaimer, the term of this patent is extended or adjusted under 35 U.S.C. 154(b) by 35 days.

(21) Appl. No.: 14/956,876

(22) Filed: Dec. 2, 2015

(65) Prior Publication Data

US 2016/0159595 A1 Jun. 9, 2016

(30) Foreign Application Priority Data

Dec. 8, 2014 (CH) ..... 1893/14

(51) Int. Cl.
*B65H 5/08* (2006.01)
*B65H 5/24* (2006.01)
(Continued)

(52) U.S. Cl.
CPC ..... *B65H 5/085* (2013.01); *B65H 5/16* (2013.01); *B65H 5/24* (2013.01); *B65H 29/003* (2013.01);
(Continued)

(58) Field of Classification Search
CPC ..... B65H 29/04; B65H 29/003; B65H 29/02; B65H 29/005; B65H 29/041; B65H 29/042; B65H 29/044; B65H 29/045; B65H 29/047; B65H 29/048; B65H 29/06; B65H 29/08; B65H 29/10; B65H 29/28;
(Continued)

(56) References Cited

U.S. PATENT DOCUMENTS 2,262,631 A * 11/1941 Belluche ..... B65H 5/14 271/206
4,604,851 A * 8/1986 Reist ..... B65H 29/003 198/431
(Continued)

FOREIGN PATENT DOCUMENTS

CH 703 119 11/2011
CH 706 769 1/2014
(Continued)

OTHER PUBLICATIONS

Switzerland Search Report dated Feb. 6, 2015, Application No. 01893/14.

*Primary Examiner* — Thomas A Morrison
(74) *Attorney, Agent, or Firm* — Hankin, Hill & Clark LLP

(57) ABSTRACT

A device for conveying and transferring flexible, flat objects with a gripper conveyor including a plurality of grippers that are movable along a conveying path in a conveying direction, and further with a conveying-way device that forms a conveying rest that, in a transfer region, is arranged below the conveying path such that objects that are released from grippers in the transfer region are deposited onto the conveying rest. The device includes a pressing circulatory device that acts upon the transfer region and has a plurality of outwardly directed pressing arms. The pressing circulatory device is designed, in the transfer region, to press the objects to be transferred with the pressing arms onto the conveying rest such that the objects can be deposited onto the conveying rest in a guided and controlled manner.

17 Claims, 9 Drawing Sheets

(51) Int. Cl.

| | |
|---|---|
| ***B65H 5/16*** | (2006.01) |
| ***B65H 29/00*** | (2006.01) |
| ***B65H 29/16*** | (2006.01) |
| ***B65H 29/24*** | (2006.01) |
| ***B65H 29/66*** | (2006.01) |

(52) U.S. Cl.
CPC ..... *B65H 29/16* (2013.01); *B65H 29/242* (2013.01); *B65H 29/6609* (2013.01); *B65H 2301/446* (2013.01); *B65H 2301/44712* (2013.01); *B65H 2301/44732* (2013.01); *B65H 2301/44735* (2013.01); *B65H 2404/1521* (2013.01); *B65H 2405/552* (2013.01)

(58) Field of Classification Search
CPC ..... B65H 29/29; B65H 5/085; B65H 5/16; B65H 5/24
USPC ..... 271/199, 204, 205, 277, 206, 82, 85
See application file for complete search history.

(56) References Cited

U.S. PATENT DOCUMENTS

| | | | | |
|---|---|---|---|---|
| 6,179,111 | B1 * | 1/2001 | Ratz | B65H 29/003 198/370.05 |
| 7,048,110 | B2 * | 5/2006 | Hachiya | B65H 29/003 198/470.1 |
| 7,591,466 | B2 * | 9/2009 | Kyburz | B65H 5/36 101/232 |
| 7,694,949 | B2 * | 4/2010 | Keane | B65H 29/003 271/277 |
| 9,051,142 | B2 | 6/2015 | Keller | |
| 2008/0001352 | A1 | 1/2008 | Jeong | |
| 2008/0067740 | A1 * | 3/2008 | Keane | B65H 29/003 271/277 |
| 2009/0194930 | A1 | 8/2009 | Stauber | |
| 2010/0320059 | A1 * | 12/2010 | Noll, Jr. | B65H 29/003 198/470.1 |
| 2011/0240441 | A1 * | 10/2011 | Stauber | B65H 5/085 198/470.1 |

FOREIGN PATENT DOCUMENTS

| | | |
|---|---|---|
| EP | 1 055 620 | 11/2000 |
| EP | 2 386 512 | 11/2011 |
| WO | 2007/051324 | 5/2007 |
| WO | 2010/051650 | 5/2010 |

* cited by examiner

DEVICE AND METHOD FOR CONVEYING FLAT OBJECTS

BACKGROUND OF THE INVENTION

Field of the Invention

The present invention lies in the field of conveying technology and relates to a device and to a method for conveying and transferring flexible, flat objects. The device includes a gripper conveyor with a plurality of grippers that are movable in a conveying direction along a conveying path, moreover a conveying-away device with a conveying rest that is arranged in a transfer region below the conveying path of the gripper conveyor such that objects released by grippers in the transfer region are deposited onto the conveying surface. The device further includes pressing devices that are designed in order, in the transfer region, to the press the objects to be transferred, onto the conveying rest such that the objects are deposited onto the conveying rest in a guided and controlled manner.

Description of Related Art

Increasingly more complex, flexible flat objects are conveyed and/or processed in another manner in printing room technology, in particular with the production of newspapers. The objects, for example, can be individual products, in particular printed products, such as newspapers, magazines, brochures or books.

More complex objects however consist of several products, hereinafter called product units. Such product units, for example, can be collections of products, which are laid onto one another. Moreover, such product units can also consist of one or more products with inserted supplements. Products units of products that are laid onto one another as well as inserted into one another are likewise known.

Moreover, it is known to insert supplements such as flyers, brochures, leaflets, goods samples, etc. into folded products, such as newspapers.

Common to objects of several products of the type described above is the fact that the individual products are grouped loosely together during their conveying. Product units with products laid onto one another as well as inserted into one another must therefore be held together by way of conveying means, such as, e.g., grippers, during their conveying.

Thus, one can also envisage the objects each including several products that are held by the gripper in manner offset to one another and that are also to be transferred with this offset.

The complexity of the objects therefore demands a very precise control of the position of the individual products at each point in time of the processing, in particular also on transfer of the objects between two conveying devices.

The grippers are opened on transfer of objects from a gripper conveyor to a conveying rest, which is arranged in the transfer region below the gripper, wherein the objects are deposited onto the conveying rest lying therebelow by way of gravitational force. Thereby, the objects are situated in freefall for a brief period of time and are therefore in an uncontrolled condition.

It is possible for the individual products to displace or rotate relative to one another when being deposited onto the conveying rest, since the individual products of the object are no longer held together by the grippers on opening the grippers. This can lead to errors with the further processing.

Devices are known, with which design measures have been a taken, which are to permit an as guided as possible deposition of objects from the grippers of a gripper conveyer onto a conveying belt of a conveying-away device.

Thus, the published document EP 2 386 512 A1 describes a device with a gripper conveyor as well as with a belt conveyor of a conveying-away device, which in the transfer region is arranged below the gripper conveyor. The belt conveyor is designed as a vacuum belt conveyor, which in the transfer region sucks the end section of the object that faces the vacuum conveying belt and lies on this already before the transfer, onto the vacuum conveying belt before the grippers are opened. The object is prevented from dislocating on opening the grippers during the unguided deposition of the object onto the conveying belt by way of this.

If the object includes several products that are loosely grouped together, e.g., products that are laid onto one another or inserted into one another, then as was hitherto the case, there exists the danger of the individual products of the object displacing with respect to one another. The lower the adhesive friction between the individual products, the greater is this danger.

This problem can be reduced by way of keeping the distance between the gripper jaw and the conveying rest as low as possible in the transfer region, so that the unguided path of the object from the gripper jaw to the conveying rest is as small as possible. This, however, necessitates the objects in the transfer region being led in an as narrow as possible gap between the gripper and conveying rest. This, in turn, limits the flexibility of the device with respect to the size, the type and the composition of the objects to be processed.

The solution for a transfer of objects from a gripper onto a conveying rest lying therebelow in a controlled and guided manner and which is described in the publication document WO 2010/051650 includes grippers with two gripper jaws, wherein a trailing gripper jaw is lengthened compared to the leading gripper jaw and includes a gripper part which, in the clamping position, extends beyond the leading gripper jaw. The objects in the transfer region are then pressed onto the conveying rest during the transfer from the projecting gripper part of the trailing gripper.

The described device, although permitting a release of the objects onto the conveying rest in a guided and controlled manner, the grippers, however, must be considerably modified for this, which for example entails the retrofitting of existing gripper conveyors at a considerable expense. Moreover, the processing speed of the device is limited, since otherwise the mechanical loading upon the extended gripper limb, which is moved through the transfer region, becomes too great.

In this context, it was otherwise ascertained that a controlled guidance of the objects on transfer onto the conveying rest is particularly necessary at low conveying speeds. This is due to the fact that at high conveying speeds, the inertia forces ensure that the products do no displace or rotate relate to one another during the short but critical transfer phase. The transfer phase accordingly lasts longer and the inertia forces are lower at low conveying speeds.

Low conveying speeds also occur temporarily with devices that are usually operated at high conveying speeds. Thus, the conveying speeds are low when starting the device from standstill or on stopping the device over a certain period of time, which in particular is characterised by an acceleration or braking ramp.

A starting-up of the device, however, is not only necessary on assuming operational production, but also after interruptions due to malfunctioning. A stoppage of the installation accordingly not only entails the finishing of the production, but can also be due to a production disturbance.

Moreover, it can occur that the device must be operated at a lower speed over a certain period of time or over the complete duration of the production for various reasons, for example due to extremely complex objects being processed.

SUMMARY OF THE INVENTION

It is therefore the object of the invention, to further develop the initially mentioned device, in a manner such that a transfer of the held objects from a gripper conveyor onto a conveying rest in a guided and controlled manner is ensured.

A further object lies in developing the device further, in a manner such that a controlled and guided transfer is ensured at low as well as high processing speeds, without the measures for the controlled and guided transfer of the objects leading to problems caused by the high processing speeds.

A further object lies in further developing the device such that existing devices can be retrofitted without excessive effort or expense.

According to the present invention, the pressing device includes a pressing circulatory device that acts upon the transfer region, which is to say affects the transfer region, and is with a plurality of pressing arms, which are movable along the pressing circulatory device and are directed outwards, wherein the pressing circulatory device is arranged and can be operated, such that in each case a pressing arm presses an object, which is to be deposited onto the conveying rest, onto the conveying rest on opening the gripper clampingly holding the object.

The pressing circulatory device is arranged in the transfer region.

The pressing circulatory device has at least one rotation axis, about which the pressing arms are movable.

According to a further development of the invention, the pressing circulatory device is a pressing wheel, which is rotatably mounted about a rotation pivot.

The pressing arms are arranged around the pressing wheel. The pressing arms are directed outwards from the rotation axis.

A transfer region is to be understood as a conveying path section along the gripper conveying path, in which the free section of the objects are applied onto the conveying rest and the objects are subsequently deposited onto the conveying rest by way of opening the grippers, and in which the pressing circulatory device with its pressing arms in the operational position applies a pressing force onto the objects to be transferred.

The pressing arm forms a contact section with a contact surface. The contact surface corresponds to that surface, with which the pressing arm lies on the object to be transferred. The contact section is arranged at the free end of the pressing arm.

According to a further development of the invention, the contact surface is formed by a low-friction material, such as PTFE (polytetrafluorethylene).

According to a further development of the pressing arm, a rotatably mounted pressing roller forming the contact surface is arranged on the contact section. The pressing roller is rotatably mounted on the contact section, such that the pressing roller, which is pressed by the pressing arm, rolls on the object to be transferred.

The pressing roller can be rotatably mounted on a stationary rotation pivot. The pressing roller can also be rotatably mounted on the contact section via its outer periphery. Other roller mountings are likewise possible.

The pressing wheel with its pressing arms in particular is designed in a shape-stable manner.

The contact section in particular describes a defined movement path, which runs about the geometric rotation axis of the pressing wheel. This is particularly a circular path.

According to a further development of the invention, the contact section with its contact surface is movable or deflectable out of its defined movement path in an elastic, in particular viscous-elastic manner, counter to the contact pressure produced on pressing the object onto the conveying rest.

Viscous-elastic means that the pressing arm has a partly elastic, partly viscous material behaviour in the case of a deflection of the contact section. The effect of this behaviour is that the deflection of the arm section due to the pressing pressure is effected comparatively quickly in a manner corresponding to an elastic behaviour, and that the resumption of the starting position subsequent to the deflection given a cessation or reduction of the contact pressure is effected comparatively slowly according to a viscous behaviour.

The pressing circulatory device is designed and arranged in the device such that the contact section with the contact surface can elastically yield by a certain amount when building up a contact pressure on the object.

The elastic deflectability of the contact section permits the transfer of differently thick objects, without the position of the pressing circulatory device with respect to the conveying rest having to be adapted. This, for example, means that the rotation axis of a pressing wheel in particular is stationary.

The different distances between the contact surface and the surface of the objects in the transfer region and which are caused by the different thicknesses of the objects are compensated by way of the contact section with the contact surface experiencing a differently large elastic deflection out of its defined movement path.

The elastic deflectability of the contact section on the pressing circulatory device moreover ensures a smoother, which is say more uniform contact pressure, even if the objects have an irregular, e.g., wavy surface or have an arcuate surface due to the imbricate deposition.

An elastic deflectability of the contact section moreover ensures that this can yield or deflect with the occurrence of knocks, e.g., by obstacles, so that the transfer process is not inhibited.

According to a further development of the invention, the pressing circulatory device includes a rotatably mounted main body, through which a geometric rotation axis leads. According to this further development, the pressing arms are moved about the main body. The pressing arms are moved about the outer periphery of the main body.

The pressing arms can be arranged on a circulating, flexible conveying element, which is led around the main body.

If the pressing circulatory device is formed by a pressing wheel, the main body is a part of the pressing wheel. The pressing arms according to this embodiment are arranged on the main body. The pressing arms are arranged on the outer periphery of the main body. The pressing arms can be fastened on the main body as separate components or, as explained in more detail further below, together with the main body form an integral shape body.

The contact sections are elastically movable or deflectable relative to the main body.

According to a further development of the invention, the pressing arm forms an elastically bendable arm section, via which the contact section with its contact surface can be elastically bent away of its circulating path.

The elastic bendability of the arm section can be achieved by way of the arm section consisting of a material with elastic characteristics, such as plastic or spring steel, or comprising this. The plastic can be an elastomer. The plastic can be a foam material.

The elastic flexibility of the arm section can also be achieved by the manner of design in combination with a material with elastic characteristics. Thus, the arm section can include one or more recesses which increase the elastic flexibility of the arm section or render it possible in the first place.

The elastic characteristics can basically also be achieved by way of a joint connection, which is arranged in the arm section and which has restoring characteristics.

According to a further development of the pressing wheel, the elastically bendable arm section of the pressing arm includes at least two arms that run from the main body in the direction of the contact section and unite in the contact second, so that the at least two part-arms together with the main body enclose a recess.

According to a further development of the pressing wheel, the main body and the pressing arms are designed in a single-part manner. This means that the main body and the pressing arms form a single-part, i.e. single-piece shape body. The shape body, for example, can be moulded as one piece. The mentioned shape body can also be formed out of a blank. The shape body can thus be punched or cut out of a blank.

The pressing wheel in particular is fastened on the device via the main body. The main body can, e.g., be attached on the device via fastening discs, e.g. by way of screw connections.

According to a further development of the device, the pressing circulatory device is movable out of a passive position, in which the pressing circulatory device with its pressing arms, in the transfer region has no influence on the transfer of the objects, into an operational position, in which the pressing arms of the pressing circulatory device, in the transfer region act upon the objects to be transferred, and again out of the operational position back into the passive position.

This permits the pressing wheel to be moved into the operational position at slow processing speeds, e.g., on starting or stopping the device, so that the objects are also deposited onto the conveying rest in a guided and controlled manner, even with slow processing speeds, in particularly during starting or stopping the device.

The function of the pressing circulatory device under certain circumstances is no longer necessary at high processing speeds, for example during the regular operation of the device, since the objects or the products contained therein are reliably deposited due to their inertia forces.

The assumption of a passive position at high processing speeds has the advantage that the pressing circulatory device is not subjected a high mechanical loading. Noise due to vibration, excessive wear and operational disturbances arising from this can be reduced by way of this.

The pressing circulatory device can be attached on the device in a manner movable relative to the device, between a passive position and operational position, in particular via a holding device. The holding device, for example, can be designed as a pivot device, via which the pressing circulatory device can be fastened on the device in a manner pivotable about a pivot axis.

The pivot device, for example, includes a pivot body such as a pivot arm, via which the pressing circulatory device is pivotably mounted on the device about a pivot axis. The geometric pivot axis corresponds to the geometric rotation axis of a drive wheel for driving the pressing circulatory device and which is yet described further below.

The pressing circulatory device can moreover cooperate with an actuation device, which is arranged on the device and via which the movement of the pressing circulatory device between its passive and operational position is triggered.

The actuation device can, e.g., comprise a retractable and extendible working cylinder such as a hydraulic cylinder or pneumatic cylinder. The retraction and extension movement of the working cylinder can be controlled via a control device.

The retraction and extension movement of the working cylinder effects a pivot movement of the pressing circulatory device about the pivot axis, in the case of the pivot device described above.

According to a further development of the invention, the pressing pressure, which the pressing arms exert upon the objects, can be set by way of a control device via the holding device, in particular via an associated actuation device.

Thus, one can envisage the pressing circulatory device being able to be moved from a passive position into a variable operational position, wherein the variable operational position is characterised by different distances between the conveying rest and the pressing arms or the rotation axis of the pressing wheel. Thereby, it is the case that the thicker are the objects to be transferred, the larger is this distance selected.

A pressing wheel considered in the conveying direction is arranged laterally of the grippers. According to a further development of the invention, the device can include two pressing wheels, wherein a first pressing wheel is arranged at a first side and a second pressing wheel at a second, opposite side of the grippers. The two pressing wheels are coupled to one another with regard to drive technology and are driven synchronously. The drive-technological coupling is a mechanical coupling.

The gripper conveyor includes a closed conveying path, along which the grippers are conveyed in a circulating manner.

The objects are conveyed into the transfer region, in particular in a hanging manner. For this, the grippers hold the objects at a first object edge. The second, free object edge, which is opposite the first object edge, in contrast is not held. It is part of a free end-section.

According to a further development of the invention, the gripper conveyor and the conveying-away device are designed and arranged relative to one another, such that the objects which are held at the first object edge by the grippers, towards the transfer region lie with their free end section on the conveying rest.

The second object edge is hereby an edge that is trailing with respect to the first object edge. The grippers for this can be directed with their gripper openings counter to the conveying direction, in the transfer region and, as the case may be, also towards the transfer region. This means that a direction component of the gripper openings is directed counter to the conveying direction.

The pressing arms are designed, in the transfer region, to press upon the free end sections of the objects, which already lie on the conveying rest. The pressing arms press onto the free end sections already before the grippers are opened and the held first object edge is released for the complete deposition of the object.

On pressing the objects onto the conveying rest, on the one hand the free end sections of the objects as a whole are temporarily held on the conveying rest, and on the other hand the products of the objects, which are loosely laid onto one another or inserted into one another, are also mutually temporarily held in a clamping manner at their end sections.

On the one hand, a slipping of the objects as a whole on the conveying rest is prevented during the transfer by way of this. Moreover, a mutual slipping of products, which are laid on one another or inserted into one another and, as a result, a falling of individually products out of an object during the transfer is also prevented.

According to a further development of the invention, the conveying path of the grippers runs arcuately from the top to be bottom towards the transfer region.

According to a further development of the device, the conveying path of the grippers, subsequent to the transfer region runs arcuately from the bottom to the top. The grippers are moved away from the conveying rest subsequently to the transfer region in this manner.

The term "bottom" and "top" relates to the direction of gravity force and counter to the gravity force respectively.

According to a further development of the device, the conveying path of the grippers towards the transfer region runs arcuately from the top to the bottom, and subsequently to the transfer region arcuately from the bottom to the top, wherein a lowermost section of the conveying path lies in the transfer region. The conveying path of the grippers is concave, considered from the conveying rest.

According to a further development of the invention, the conveying rest towards the transfer region runs arcuately from the top to the bottom. The gripper conveyor and the conveying-away device towards the transfer region can form a conveying gap, which runs arcuately from the top to the bottom and in which the objects lie on the conveying rest with their trailing, free end section.

According to a further development of the device, the conveying rest subsequently to the transfer region runs along a plane. The conveying rest subsequently to the transfer region runs horizontally.

According to a further development of the invention, the conveying-away device includes at least one belt conveyor, wherein the conveying rest is formed by the conveying belt of the at least one belt conveyor.

The conveying-away device can include several belt conveyors that are arranged successively and/or next to one another in the process direction.

The at least one belt conveyor can be designed as a vacuum belt conveyor. The vacuum belt conveyor includes a conveying belt with suction openings. The conveying belt cooperates with a vacuum source, by way of which air is sucked from the conveying rest through the suction openings in the conveying belt. The objects that are deposited on the conveying belt are sucked onto the conveying rest by way of the suction pull, by which means a slipping of the objects on the conveying rest is prevented. Such a vacuum belt conveyor is described, e.g., in the published document EP 2 386 512 A1.

The pressing circulatory device is driven synchronously to the grippers of the gripper conveyor via a drive device. The drive device for this can be designed to take the drive force from the conveying element, on which the grippers are fastened. The conveying element can, e.g., be a conveying chain.

The drive device includes a mechanical gear such as a toothed belt gear, via which the drive force is transmitted onto the pressing circulatory device. The drive force for the pressing circulatory device can be taken from the conveying element, so that the movement speed of the pressing arms or the rotation speed of the pressing wheel is coupled to the conveying speed of the gripper conveyor. An operation of the pressing circulatory device, which is cyclically synchronous (pace-synchronous) to the gripper conveyor, is possible by way of this.

The drive force can be taken from the conveying element via a drive wheel. The torque of the drive wheel is transmitted onto the pressing circulatory device via a gear, such as a toothed belt gear.

The invention moreover relates to a method for conveying and transferring flexible, flat objects with a device according to the above description.

The method includes the following steps:

- moving a closed gripper with an object, which is held by the gripper and which is to be transferred, to the transfer region;
- moving a pressing arm along the pressing circulatory device into the transfer region, wherein the pressing arm that is moved into the transfer region, in the transfer region presses the object to be transferred, onto the conveying rest;
- opening the gripper, which holds the object to be transferred, in the transfer region depositing the object to be transferred onto the conveying rest.

In the transfer region, the pressing arm with the contact surface of the contact section accompanies the object, in a touching manner during the transfer. The region of the touching accompanying in the transfer region is called the contact region. Thereby, the pressing arm is moved through the contact region essentially at the same speed as the object to be released.

If the pressing circulatory device is a pressing wheel, then the pressing wheel is rotated about its rotation axis, such that a co-rotating pressing arm is moved into the transfer region and in the transfer region presses the object to be transferred, onto the conveying rest.

The objects to be transferred, in the transfer region are pressed against the conveying rest by the pressing arm during the opening of the grippers.

The objects to be transferred, in the transfer region are pressed by the pressing arm against the conveying rest, during a defined time period before, during and after the opening of the grippers.

Thereby, the pressing arms, as mentioned above, in particular press a trailing end section of the objects against the rest surface. This trailing end section lies on the conveying rest already before the transfer of the objects.

The pressing arms are guided such that these with their contact section are moved through the transfer region, in each case between two consecutive objects.

Considered from the side in the conveying direction, the pressing arms with their contact sections in particular are moved between two consecutive grippers. This means that the pressing arms are moved through the transfer region in a manner phase-shifted to the grippers.

According to a further development of the invention, the pressing arm, which in the transfer region presses the object to be transferred onto the conveying rest, is moved further along the pressing circulatory device, wherein the pressing arm subsequently to the transfer of the object is moved further along its movement path again away from the transferred object amid the lifting of the pressing contact.

If the pressing circulatory device is a pressing wheel, then this is rotated further about its rotational axis, such that the co-rotating pressing arm, which in the transfer region presses the object to be transferred onto the conveying rest, is moved away again from the transferred object amid the lifting of the pressing contact, subsequently to the transfer of the object.

As already mentioned, the pressing arms moved through the transfer region in a manner cyclically synchronous to the grippers. Accordingly, the pressing circulatory device is moved at a speed that is synchronous to the conveying speed of the conveying element.

The objects in particular are deposited onto the conveying rest in a conveying formation, such as imbricate formation, and are fed to a further processing device with an imbricate stream.

The further processing device can be a stacking device, in which the objects are stacked. The further processing device can be a film wrapping device, in which the objects are film-wrapped. The further processing device can be an addressing device, in which the objects are addressed.

The invention has the advantage that differently thick objects can be transferred, without having to carry out settings at the pressing means every time. The pressing device moreover permits a simple and inexpensive retrofitting of existing devices, without the gripper conveyor and the conveying-away device themselves having to be rebuilt. The pressing device permits the assumption of a passive position and operational position, so that these can be applied in a selective manner.

BRIEF DESCRIPTION OF THE DRAWINGS

Embodiment examples of the invention are represented in the drawings and are described hereinafter. There are shown schematically in.

DETAILED DESCRIPTION OF THE INVENTION

Figure 1:
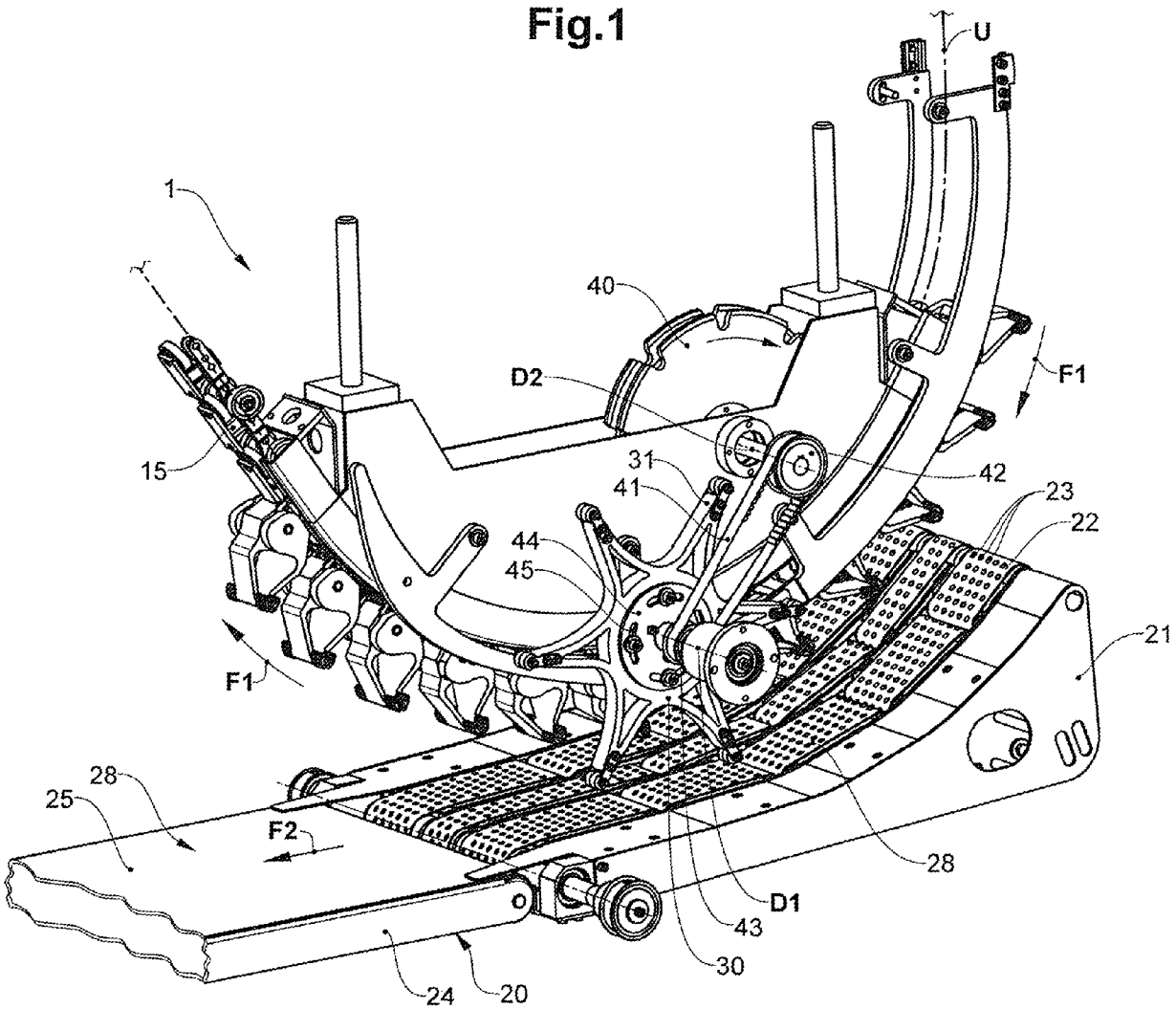
FIG. 1 a perspective view of a device according to the invention and according to a first embodiment.

FIGS. 1, 2*a*-2*d* and 3 show a device 1 according to the invention and according to a first embodiment.

The device 1 includes a gripper conveyor 10 with a plurality of grippers 11, which are moved along a gripper conveying path U and which are distanced to one another.

The device 1 further includes an onward conveying device 20 with a conveying rest 28. The gripper conveyor 10 and the onward conveying device 20 form a transfer region T, in which objects 2, 2' are released from the grippers 11 of the gripper conveyor 10 and are deposited onto the conveying rest 28 of the onward conveying device 20.

The conveying rest 28 of the onward conveying device 20, in the transfer region T, is arranged below the grippers 11 of the gripper conveyor 10. The conveying path U of the gripper conveyor runs arcuately towards the transfer region T from the top to the bottom towards the conveying rest and subsequently to the transfer region T runs arcuately from the bottom to the top away from the conveying rest 28. The grippers 11 reach their lowermost position in the transfer region T. The course of the gripper conveying path U considered from the conveying rest 28 is concave in the transfer region T.

The grippers 11 are fastened on a driven conveying chain. The grippers 11 can be opened in the transfer region T via mechanical or electric control elements. The methods for opening the grippers are of a minor significance with regard to the present invention, and thus not dealt with in more detail at this location.

The conveying-away device 20 includes a vacuum belt conveyor 21 and a takeover conveyor 24, which connects to this in the conveying direction F2.

The vacuum belt conveyor 21 includes a plurality of circulatorily guided vacuum belts 21 with suction openings 23, which together form a conveying rest 28. The conveying rest 28 of the vacuum belt conveyor 21 runs arcuately, i.e. convexly, from the top to the bottom in the conveying direction F2 towards the transfer region T.

The gripper conveying path U likewise runs arcuately convexly from the top to the bottom towards the transfer region T in the conveying direction F2. Accordingly, the gripper conveying path U and the conveying rest 28 form an arched conveying gap. This conveying gap is dimensioned such that the grippers 11 are led through the conveying gap at such a distance to the conveying rest 28 that the objects 2, 2' with their trailing free end sections 5 lie on the conveying rest 28 on running into the transfer region T.

A takeover belt conveyor 24 with a takeover conveying belt 25 receiving the deposited objects 2, 2' from the vacuum belt conveyor 21 connects to the vacuum belt conveyor 21 in the conveying direction F2.

The objects 2, 2' on deposition onto the vacuum conveying belt 22 are fixedly sucked on the conveying rest 28 by way of the suction pull, which is applied at the suction openings 23. A slipping of the objects 2, 2' on the conveying rest 28 of the vacuum conveyor 21 is prevented by way of this suction pull. This is particularly important in the arcuate run-in towards the transfer region T, where the objects 2, 2' can slip downwards in particular on account of gravitational force.

Figure 6:
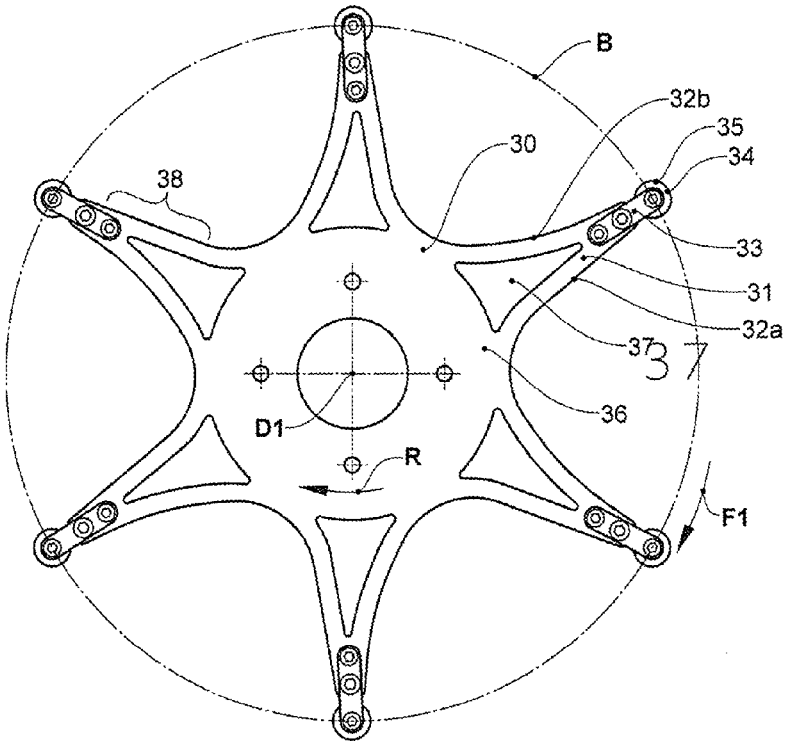
FIG. 6 a first embodiment of a pressing wheel.

A pressing wheel 30 is rotatably arranged in the transfer region T. The pressing wheel 30, as is represented in the FIGS. 1, 2*a*-2*d*, 3, 4 as well as 5*a*-5*d* in the context of the device according to the invention, is represented in FIG. 6 in an enlarged representation. FIG. 6 is referred to concerning the details of the pressing wheel 30.

The pressing wheel 30 includes a main body 36 and pressing arms 31, which are directed radially outwardly from the main body. The main body 36 and the pressing arms 31 are formed from a single-part shape body. This body consists of a foam material (plastic) and has elastic characteristics.

The pressing arms 31 in each case include two part-arms 32*a*, 32*b*, which depart from the main body 36 and which unite towards a contact section 33. The part-arms 32*a*, 32*b* with the main body 36 enclose a recess 37. The part-arms 32*a*, 32*b* form an elastic arm section 38, via which the contact section 33 can be elastically deflected out of its defined movement path B.

The pressing arm 31 towards its free end forms a contact section 33. The contact section includes a pressing roller 34, which is rotatably mounted about a rotation axis. The pressing roller 32 forms a contact surface 35, via which the pressing arm 32 presses the object 2, 2' to be transferred, towards the conveying rest 28.

The device 1 moreover includes a drive wheel 40, which is coupled to the gripper conveying chain 15 and is driven via this. The drive wheel 40 in turn transmits a drive torque onto the pressing wheel via a gear.

The gear includes at least one gear wheel 42, which is coupled to the drive wheel 40 and with this forms the common rotation axis D2, as well as a second gear wheel 43, which is coupled to the pressing wheel 30 and with this forms the common rotation axis D1. The two gear wheels 42, 43 are wrapped by a drive toothed belt 41, which transmits torque from the first gear wheel 42 onto the second gear wheel 43 and via this onto the pressing wheel 30.

The rotation movement of the pressing wheel 30 is thus coupled to the movement of the conveying chain 15, so that the rotation speed of the pressing wheel 30 is synchronous to the conveying speed of the grippers. This permits a movement of the pressing arms 31 in the transfer region T, which is cyclically synchronous to the grippers 11.

FIGS. 2*a* to 2*d* now show the course of the transfer of an object 2 from the gripper conveyor 10 onto the conveying rest 28 of the conveying-away device 20.

The object 2, held by a gripper 11, is fed in the conveying direction F1 to the transfer region T. The free end section 5 of the object 2, which is held by the gripper 11, is deposited onto the conveying rest 28 towards the transfer region T. The free end section 5 is conveyed into the transfer region T in a manner trailing the gripper 11.

A pressing arm 31 of the rotating pressing wheel 30 is moved downward towards the trailing end section 5, in the transfer region T. The pressing arm 31 via the pressing roller 34 exerts a pressing force onto the end section 5 lying on the conveying rest 28 and this pressing force prevents a slipping of the object 2 or individual products of the object 2. The object is thereby still held by the gripper 11.

Figure 2A:
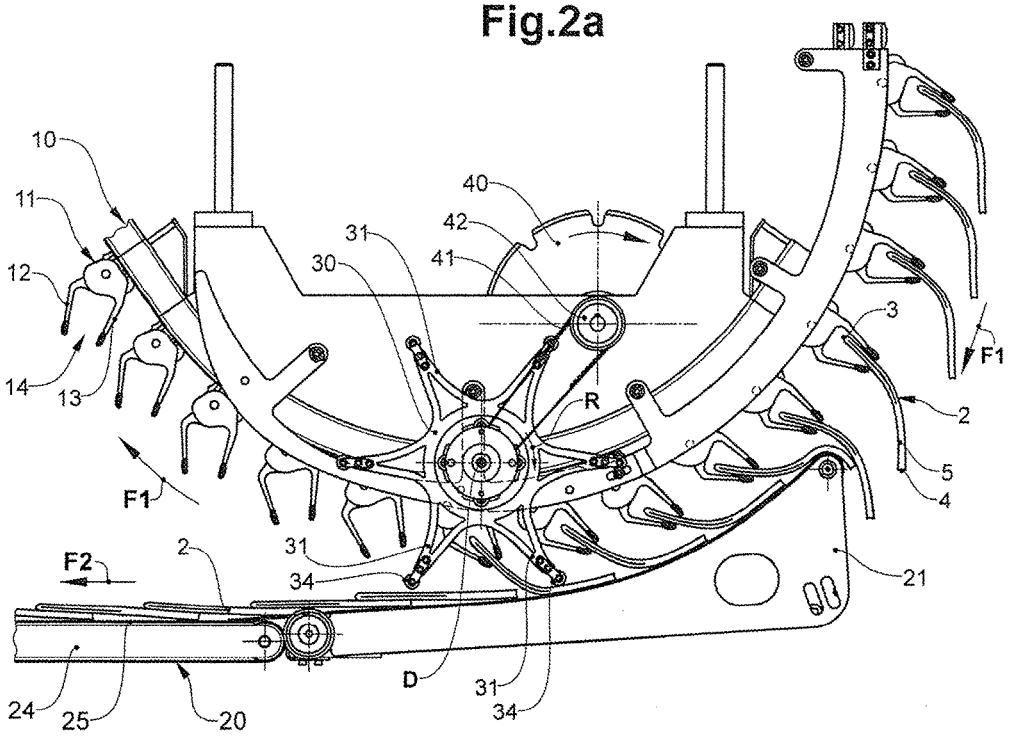
FIG. 2*a*-2*d* lateral views of the device according to FIG. 1 at different points in time in a chronological sequence during operation of the device.
Figure 2B:
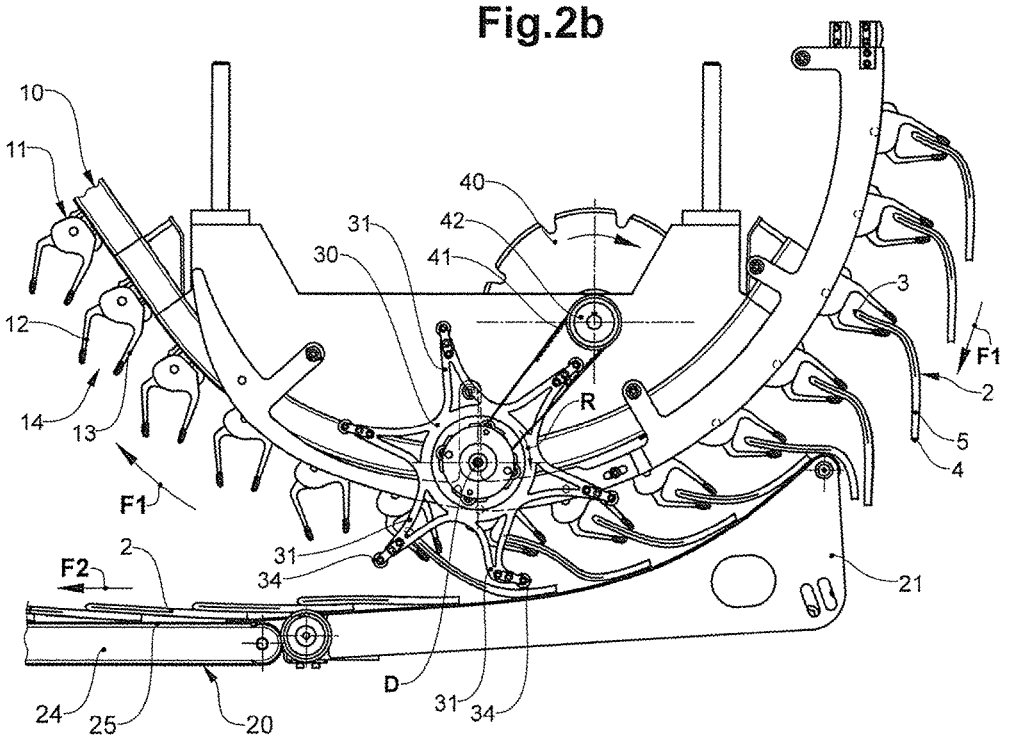

The contact section 33 with the pressing roller 34 is elastically deflected in dependence on the thickness of the object 2, by way of the pressing force, which is applied onto the object 2. The elastic part-arms 32*a*, 32*b* in the elastic arm section hereby deform (FIG. 2*a*, 2*b*).

The pressing arm 31 now, whilst exerting a pressing force onto the end section 5, moves further in a manner cyclically synchronised with the gripper 11 and accordingly with the associated object 2.

The gripper 11 is subsequently opened, wherein the leading, first edge 3 is lowered to the conveying rest 28, and the object 2, which is secured against slippage by the pressing arm 31, is completely deposited onto the conveying rest 28.

Figure 2C:
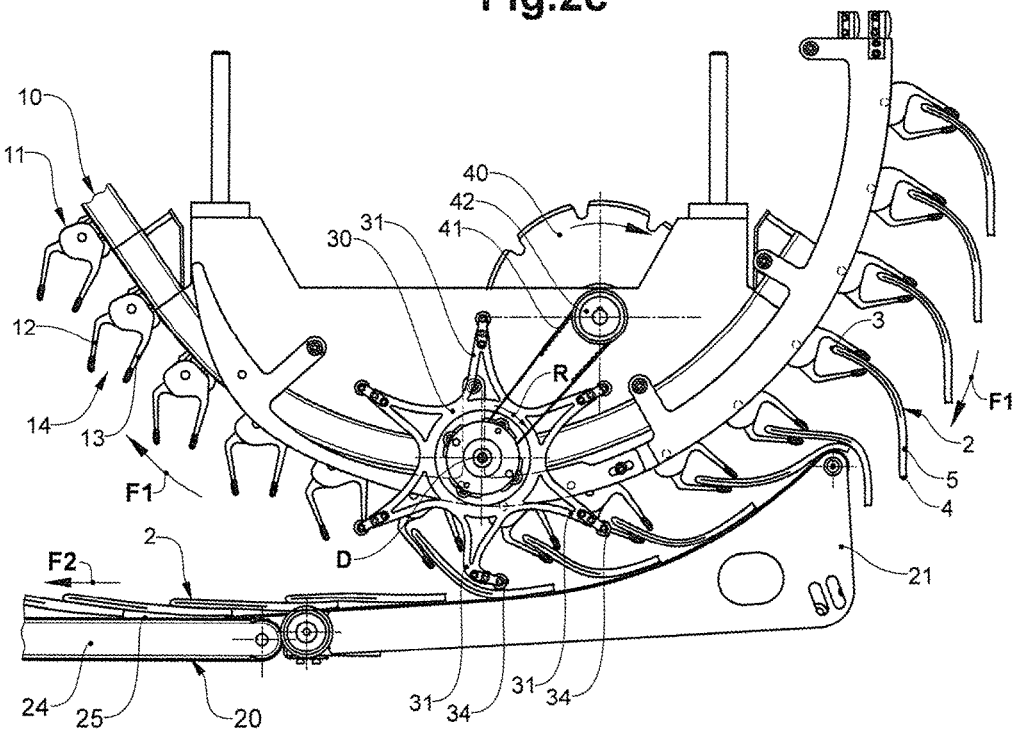
Figure 2D:
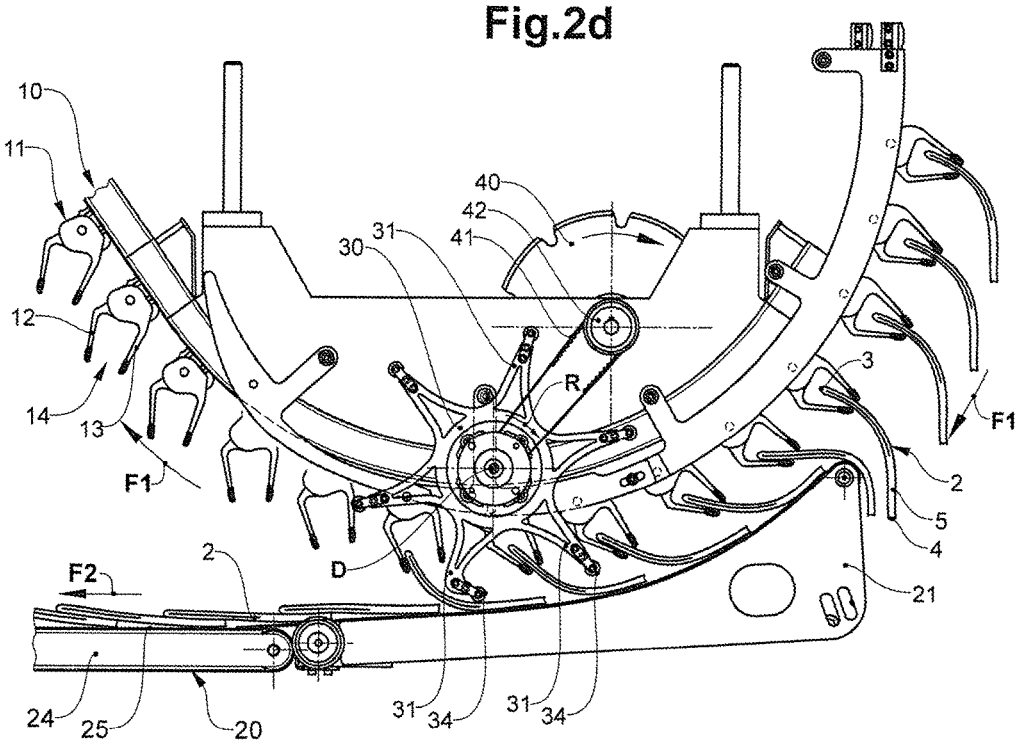

The pressing arm 31, after the object 2 has been completely deposited on the conveying rest 28, is moved upwards away from the transferred object 2 amid the lifting of the pressing force, by way of the continued rotation of the pressing wheel 30. The object 2 is transported further, in a manner lying on the conveying-away device 20. The consecutively transferred objects 2 thereby form an imbricate stream (FIG. 2*c*, 2*d*).

Figure 3:
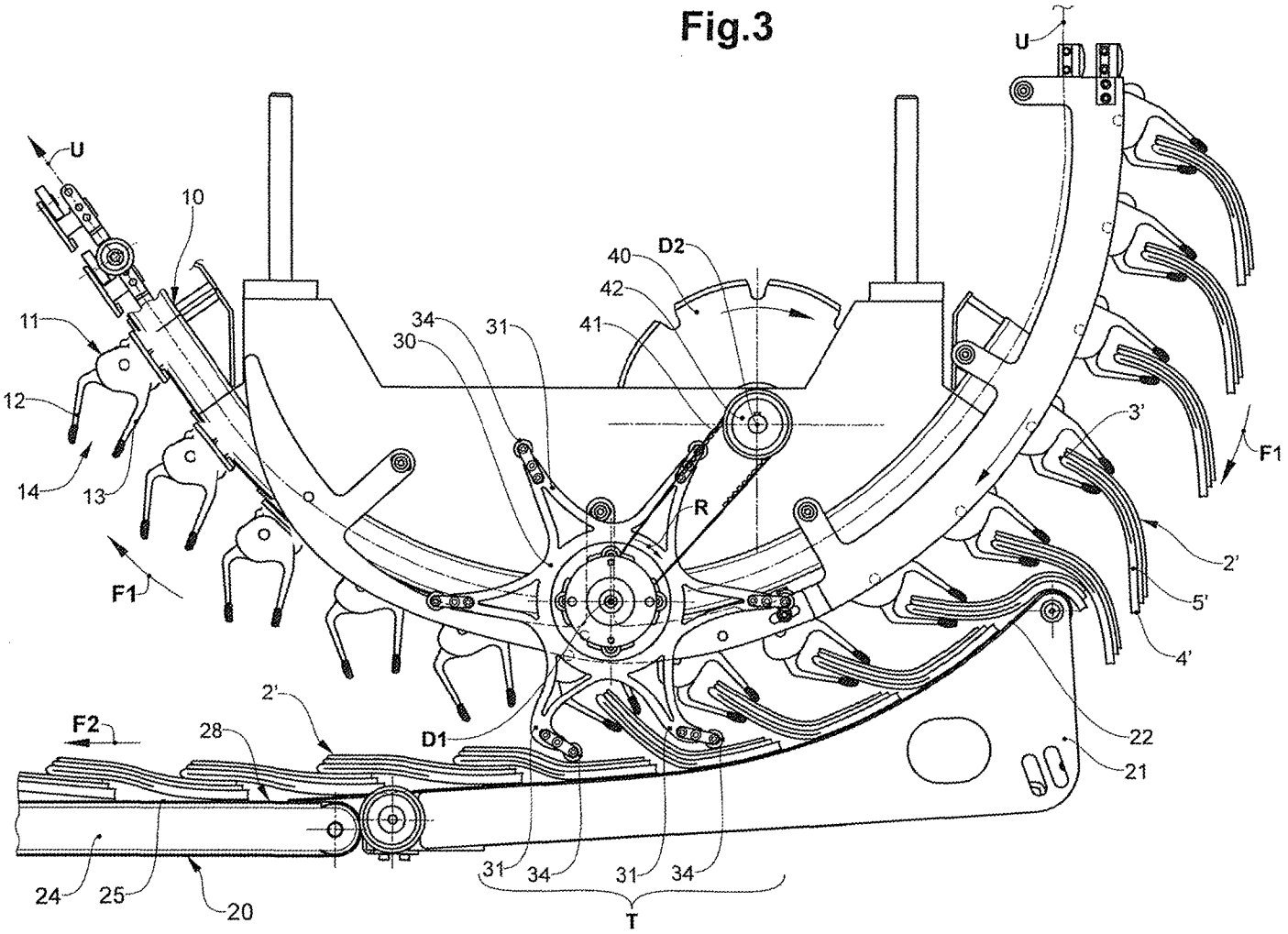
FIG. 3 a lateral view of the device according to FIG. 1 with other objects.

FIG. 3 shows the same device as in FIGS. 1 and 2*a* to 2*d*, with the difference that significantly thicker objects 2' are processed in FIG. 3. Accordingly, the deflection of the pressing arms 31, which exert a pressing force onto the objects 2', turns out to be larger.

Figure 4:
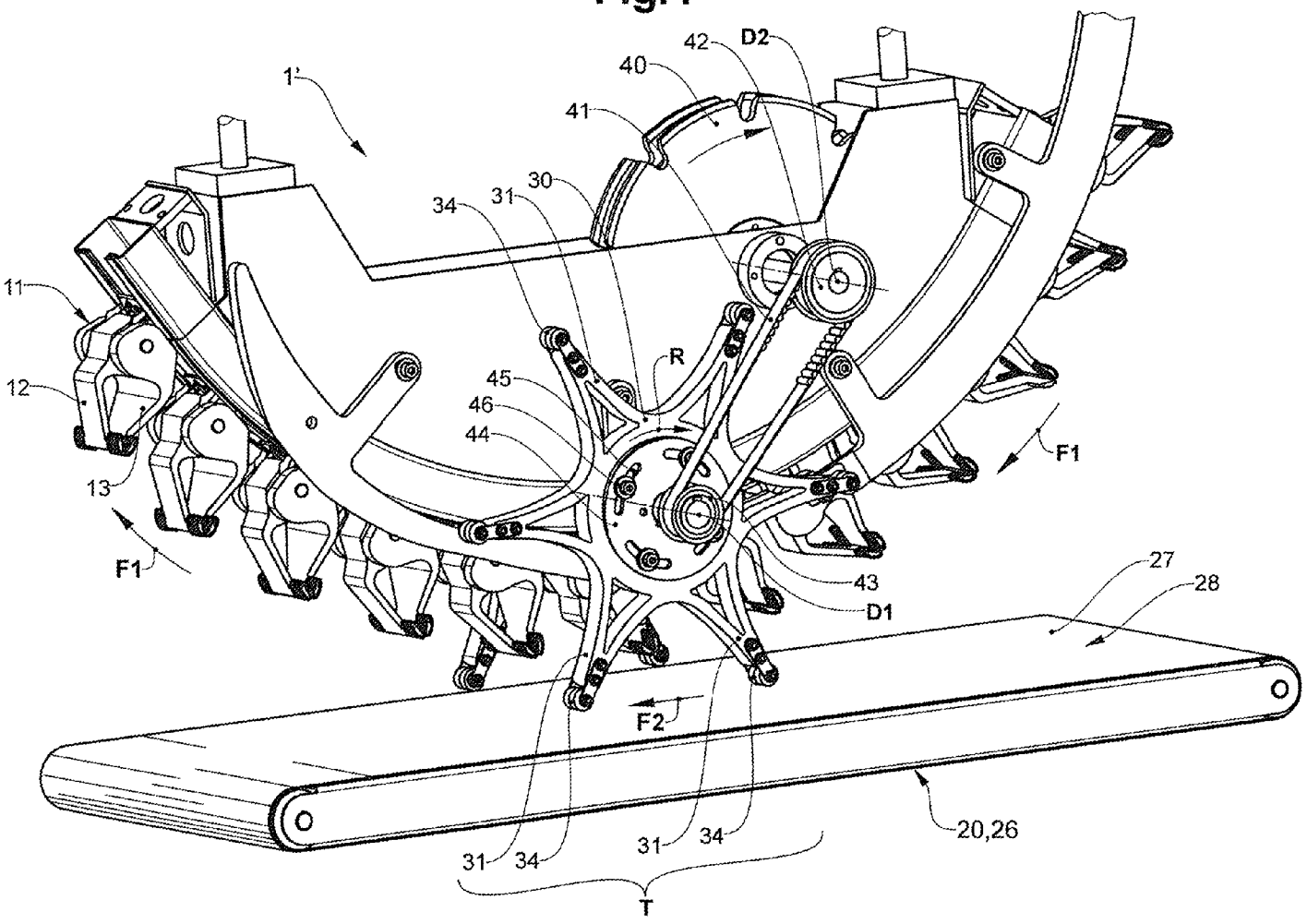
FIG. 4 a perspective view of a device according to the invention, according to a second embodiment.

The device according to the second embodiment according to FIG. 4 differs from the device according to the first embodiment according to FIGS. 1, 2*a*-2*d* and 3 by way of the conveying-away device 20'. The conveying-way device 20' here is formed by an individual belt conveyor 36 with a conveying belt 27, which is led horizontally in the transfer region T. Accordingly, the conveying rest 28 is likewise horizontal.

The transfer of the objects (not shown) in the device according to FIG. 4, with the exception of the suction adhesion on a vacuum belt, is however basically analogous to the method according to FIG. 2*a*-2*d*. The object is fed to the transfer region T in the conveying direction F1 in a manner held by a gripper 11, also according to the device according to FIG. 4.

The free end section of the object held by the gripper 11 is likewise deposited onto the conveying rest 28, towards the transfer region T. The free end section is conveyed into the transfer region T in a manner trailing the gripper 11.

Figure 5B:
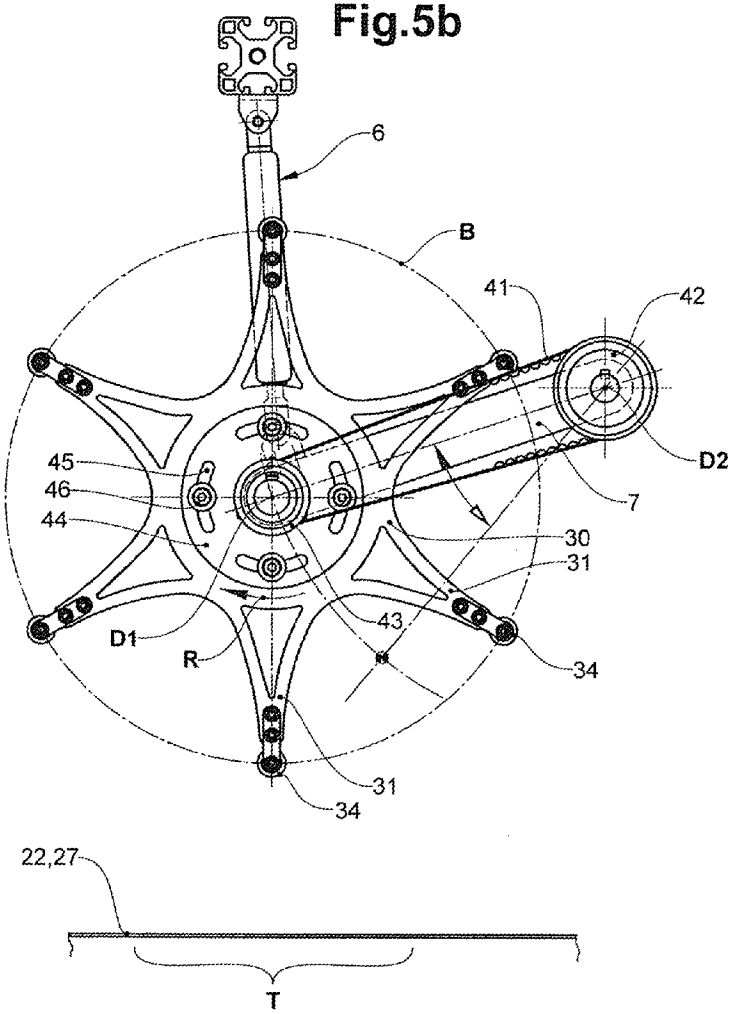
FIG. 5*a*-5*b* lateral views of a pressing wheel according to FIG. 6, with a pivot device in different pivot positions.
Figure 5A:
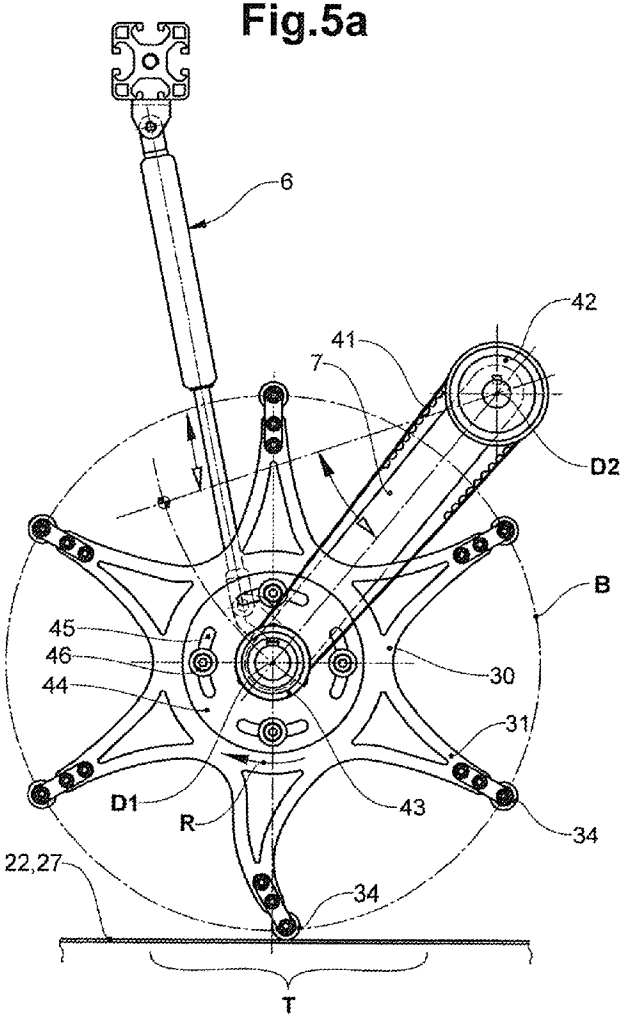

The type of fastening of the pressing wheel 30 on the device 1', as for example is also the case with the embodiment according to FIGS. 1 and 5*a*, 5*b*, can be deduced particularly well from FIG. 4.

The main body 36 of the pressing wheel 30 is screwed to a connection disc 44 in a rotationally fixed manner, so that the torque, which is introduced via the drive wheel 40, can be transmitted via the connection disk 44 onto the main body 36 and thus onto the pressing arms 31. For this, the connection disk 44 includes arch slot openings 45, through which fastening screws 46 are led.

The arch slot openings 45 permit the alignment and thus adjustment of the pressing arms 31 in or counter to the rotation direction of the pressing wheel 30 before creating the rotationally fixed connection between the main body 36 and the connection disc 44. In this manner, the pressing arms 31 can be precisely aligned relative to the grippers 11 before starting operation of the device, and a phase shift to the gripper can therefore be set.

The connection disc 44 can be of metal or plastic.

FIGS. 5*a* and 5*b* shows the pressing wheel 31 according to FIGS. 1, 2*a*-2*d*, 3 and 4 with a pivot device, as could be applied in the devices according to FIGS. 1, 2*a*-2*d*, 3 and 4.

The pivot device includes an actuation device with a hydraulic cylinder 6, which can be extended and retracted and is connected with a first end section on the stationary support structure of the device and with a second end section to the pressing wheel 30.

The pressing wheel 30 is pivotably mounted about the rotation axis D2 of the drive wheel 40 via a pivot arm 7. The pivoting mounting about the drive wheel 40 serves for keeping the distance between the rotation axes D1 and D2 in the different pivot positions, so that the gear arrangement with toothed belts 41 does not have to be adapted to the different pivot positions.

The pressing wheel 30 is pivoted about the rotation axis D2 to the transfer region T into the operational position (FIG. 5*a*), by way of extending the hydraulic cylinder 6. The pressing wheel 30 is pivoted out of the transfer region T into the passive position (FIG. 5*b*) by way of retracting the hydraulic cylinder 6.

FIGS. 6 to 9 show different embodiments of pressing wheels 30, 50, 60, 70 with single-part shape bodies, which include the main body 36, 56, 66, 76 as well as the pressing arms 31, 51, 61, 71.

The pressing wheel 30 according to FIG. 6 with its radially outwardly directed pressing arms 31 has already been described further above.

Figure 7:
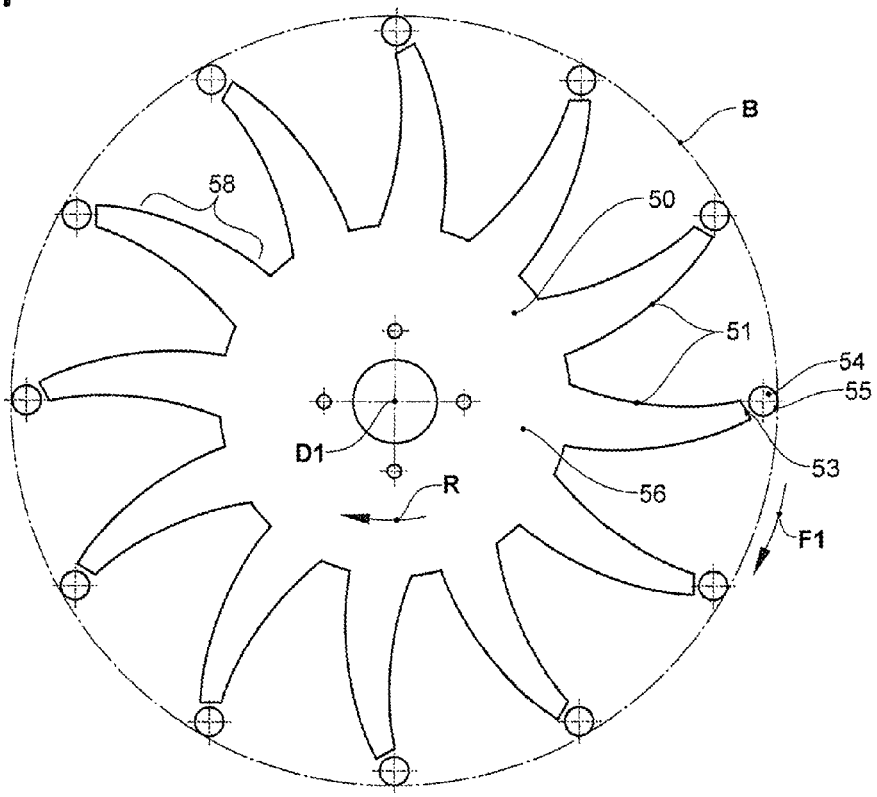
FIG. 7 a second embodiment of a pressing wheel.

The pressing wheel 50 according to FIG. 7 likewise includes a main body 56 and pressing rams 51, which are directed radially outwards, departing from the main body 56. The pressing arms 51 in the transfer region are bent slightly outwards counter to the rotation direction and accordingly counter to the conveying direction F1 into the envisaged deflection direction of the contact section 53, by which means the deflection of the contact section 53 is simplified. The pressing arm 51 include an elastic arm section 58, via which the contact section 53 can be elastically deflected out of its defined movement path B.

A pressing roller 54, which forms a contact surface 55, is arranged on the contact section 53. The pressing roller 54 is merely represented schematically.

Figure 8:
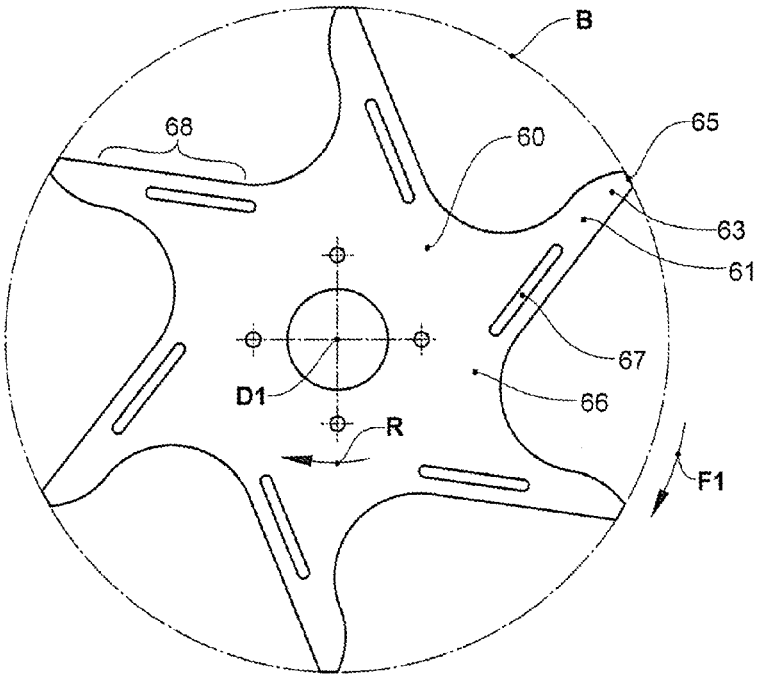
FIG. 8 a third embodiment of a pressing wheel.

The pressing wheel 60 according to FIG. 8 likewise includes a main body 66 and pressing arms 61, which are directed radially outwards departing from the main body 66. The pressing arms 61 in the transfer region T run inclined obliquely outwards counter to the rotation direction and accordingly counter to the conveying direction F1. The pressing arms 61 are accordingly obliquely inclined into the envisaged deflection direction of the contact sections 63, by which means the deflection of the contact section 63 is simplified. The pressing arm 61 includes an elastic arm section 68 with a recess 67, via which the contact section 63 can be elastically deflected out of its defined movement path B. The contact surface 65 of the contact section 63 is designed as a sliding surface.

Figure 9:
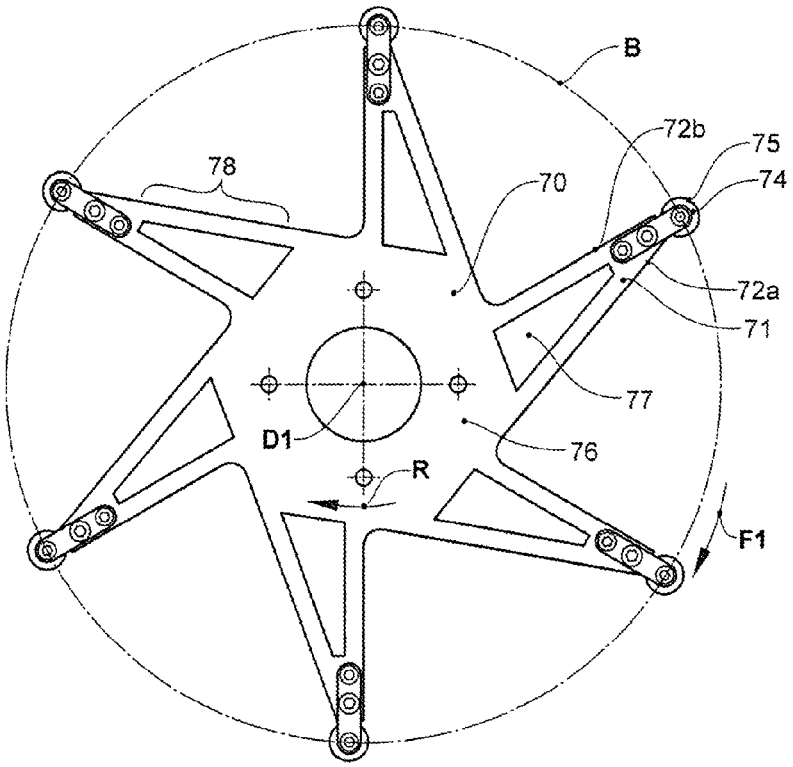
FIG. 9 a fourth embodiment of a pressing wheel.

The pressing wheel 70 according to FIG. 9 likewise includes a main body 76 and pressing arms 71, which are directed radially outwards departing from the main body 76. The pressing arms 71 in the transfer region T run inclined obliquely outwards counter to the rotation direction and accordingly counter to the conveying direction F1. The pressing arms 71 are accordingly obliquely inclined into the envisaged deflection direction of the contact section 73, by which means the deflection of the contact section 73 is simplified.

The pressing arm 71 includes two part-arms 72*a*, 72*b*, which depart from the main body 76 and which unite towards the contact section 73. The part-arms 72*a*, 72*b* together with the main body 76 enclose a recess 77. The part-arms 72*a*, 72*b* form the elastic arm section 78, via which the contact section 73 can be elastically deflected out of its defined conveying path B.

A pressing roller 74, which forms a contact surface 75, is arranged on the contact section 73, analogously to the embodiment variant according to FIG. 6.

Figure 10:
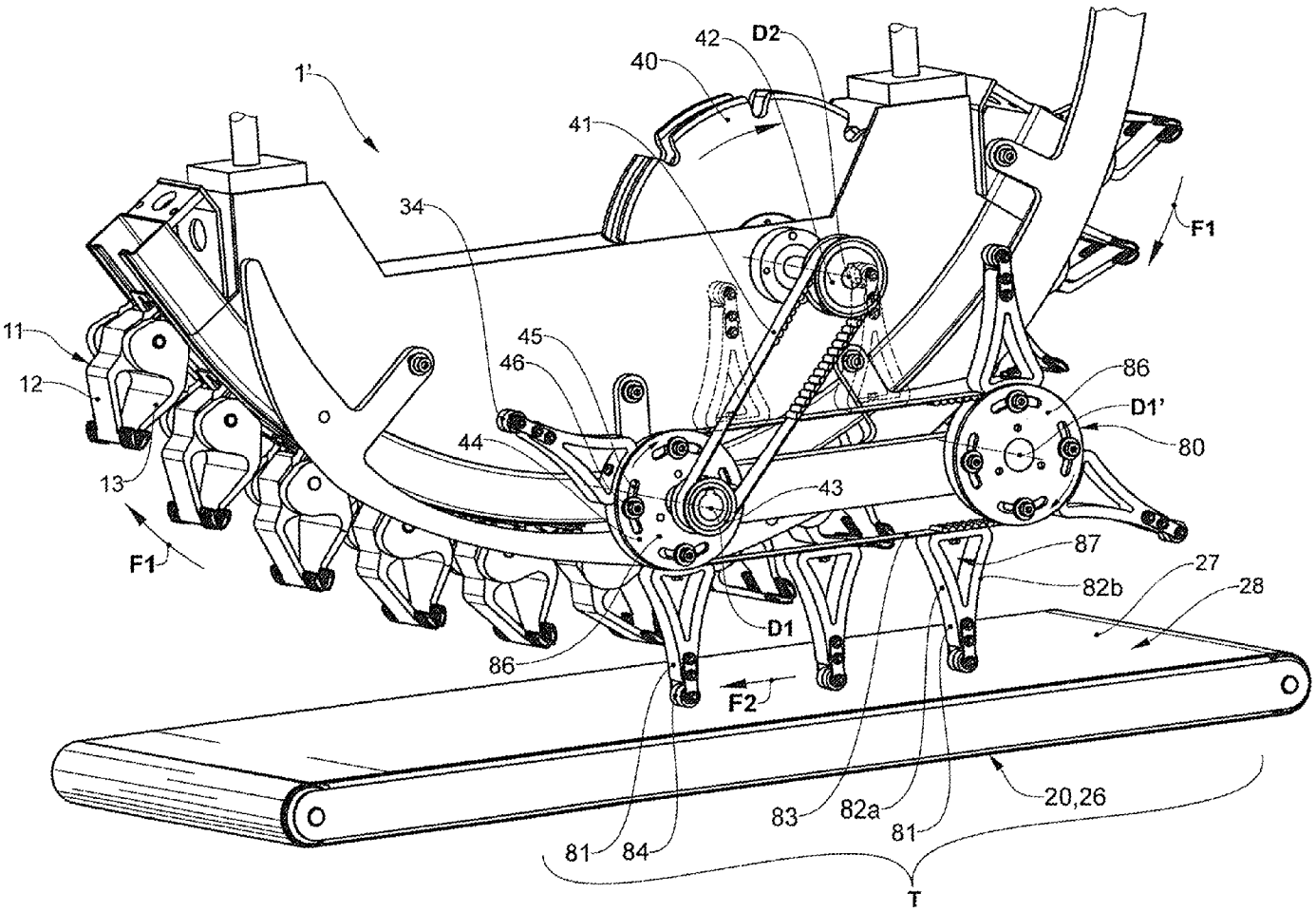
FIG. 10 a perspective view of a device according to the invention, according to a third embodiment.

The device according to FIG. 10 is constructed analogously to the device according to FIG. 4, with the exception of the pressing circulatory device 80. The pressing circulatory device 80 includes two base bodies 86 that are spaced from one another and are each rotatably mounted about a rotation axis D1, DP.

The one main body 86 is driven via a gear 42, 43 with a toothed belt 41, analogously to the pressing wheel according to FIGS. 1, 2, 3 and 4. The corresponding description further above is therefore referred to with respect to the drive of the main body 86.

The pressing circulatory device 80 moreover includes a toothed belt 83, which is circulatorily led around the two base bodies 86 and on which outwardly pointing pressing arms 81 that are spaced from one another are arranged.

The pressing arms 81 correspond to the pressing arms, which are described in FIGS. 1, 2, 3, 4, 5 and 6, but with the difference that the pressing arms are not an integral part of the main body, but rather are attached on the toothed belt 83.

Accordingly, the pressing arms 81 likewise each include a first and second part-arm 82*a*, 82*b*, which enclose a recess 87. Moreover, a pressing roller 84 is likewise arranged in a rotatably mounted manner on the outer end of the contact section.40

The invention claimed is:

1. An installation for conveying and transferring flexible, flat objects, comprising:

a first circulatory device comprising a gripper conveyor with a plurality of grippers that are fastened on a conveying chain and that are movable along a closed gripper conveying path in a conveying direction, each of the plurality of grippers being adapted to grip an associated object, a conveying-away device with a conveying member that forms a moveable conveying rest which, in a transfer region, is arranged below the gripper conveying path of the gripper conveyor such that objects that are released from grippers in the transfer region are deposited onto the moveable conveying rest, a pressing device that, in the transfer region, presses the objects to be transferred onto the moveable conveying rest such that the objects are deposited on the moveable conveying rest in a guided and controlled manner, wherein the pressing device is a second circulatory device comprising a rotatable pressing wheel that acts upon the objects to be transferred in the transfer region and has a plurality of pressing arms that are movable along a closed movement path and are outwardly directed, wherein the pressing circulatory device is arranged and driven such that, in each case, one of the plurality of pressing arms presses the object to be deposited onto the moveable conveying rest upon opening of the associated one of the plurality of grippers that is holding the object, wherein the pressing arms, in each case, form a contact section with a contact surface that presses against the object with a contact pressure such that the flexible, flat objects are clamped between the contact surface of the pressing arm and the moveable conveying rest.

2. The installation according to claim 1, wherein the pressing wheel is rotatably mounted about a rotation axis.

3. The installation according to claim 1, wherein the contact section with the contact surface is elastically deflectable counter to the contact pressure when the pressing arms press the object onto the conveying rest.

4. The installation according to claim 2, wherein the second circulatory device comprises a rotatably mounted main body through which a geometric rotation axis leads, and wherein the pressing arms project outwards from the main body and are arranged around the main body.

5. The installation according to claim 4, wherein the pressing arms and the main body are formed as a single-part component.

6. The installation according to claim 3, wherein the pressing arms, in each case, form an elastically bendable arm section via which the contact section with the contact surface is elastically deflectable.

7. The installation according to claim 4, wherein the pressing arms, in each case, form an elastically bendable arm section via which the contact section with the contact surface is elastically deflectable, and wherein the elastically bendable arm section of each of the pressing arms comprises at least two part-arms that extend from the main body in a direction of the contact section and unite towards the contact section, and wherein the at least two part-arms, together with the main body, enclose a recess.

8. The installation according to claim 6, wherein the elastically bendable arm section of each of the pressing arms is formed from a plastic having elastic characteristics.

9. The installation according to claim 8, wherein the elastically bendable arm section is formed from foam having elastic characteristics.

10. The installation according to claim 1, wherein a pressing roller that forms a contact surface is arranged on a contact section of each of the pressing arms.

11. The installation according to claim 1, wherein the second circulatory device via a holding device can be moved out of a passive position, in which, in the transfer region, the pressing circulatory device exerts no influence on the transfer of the objects, into an operational position, in which, in the transfer region, the pressing arms act upon the objects to be transferred, and again out of the operational position into the passive position.

12. The installation according to claim 1, wherein the second circulatory device via a drive device can be driven synchronously with the grippers of the gripper conveyor.

13. A method for conveying and transferring flexible, flat objects, in particular printed products, with an installation according to claim 1, comprising the steps of:

moving a closed gripper of the plurality of grippers of the gripper conveyor together with an object that is held by said closed gripper to the transfer region;

moving a pressing arm of the plurality of pressing arms along the second circulatory device into the transfer region, wherein the pressing arm that is moved into the transfer region, in the transfer region, presses the object to be transferred onto the conveying rest;

opening the closed gripper, which holds the object to be transferred, in the transfer region;

depositing the object to be transferred onto the conveying rest.

14. The method according to claim 13, wherein, during the transfer in the transfer region, said pressing arm of the plurality of pressing arms with a contact surface of a contact section touchingly accompanies the object and thereby is moved at a same speed as the object to be released.

15. The method according to claim 13, wherein the object to be transferred, in the transfer region, is pressed by said pressing arm of the plurality of pressing arms against the conveying rest during the opening of the closed gripper.

16. The method according to claim 13, further comprising the steps of:

moving said pressing arm of the plurality of pressing arms, which in the transfer region presses the object to be transferred onto the conveying rest, further along the second circulatory device, wherein said pressing arm of the plurality of pressing arms subsequently to the transfer of the object is again moved away from the transferred object amid lifting of said pressing arm of the plurality of pressing arms.

17. The method according to claim 13, wherein said pressing arm of the plurality of pressing arms in the transfer region is moved cyclically synchronously and phase-shifted to the plurality of grippers.

* * * * *